United States Patent [19]

Byers

[11] 4,418,588

[45] Dec. 6, 1983

[54] SHARPENING DEVICE FOR SINGLE EDGE TYPE CUTTING BLADES

[76] Inventor: John E. Byers, P.O. Box 556, Whitefish, Mont. 59937

[21] Appl. No.: 353,051

[22] Filed: Mar. 1, 1982

[51] Int. Cl.[3] ..... B21K 11/00

[52] U.S. Cl. ..... 76/88; 76/82.2; 76/82.1

[58] Field of Search ..... 76/86, 88, 82.2, 82.1, 76/82, 83

[56] References Cited

U.S. PATENT DOCUMENTS

| | | | |
|---|---|---|---|
| 665,895 | 1/1901 | Foster | 76/88 |
| 3,149,506 | 9/1964 | Heinmiller | 76/86 |

FOREIGN PATENT DOCUMENTS

| | | | |
|---|---|---|---|
| 6915 | of 1905 | United Kingdom | 76/86 |
| 27844 | of 1908 | United Kingdom | 76/86 |

*Primary Examiner*—Roscoe V. Parker

*Attorney, Agent, or Firm*—Cole, Jensen & Puntigam

[57] ABSTRACT

Hand held sharpening device for tools and instruments having single cutting edge type blades such as lawnmowers and the like. A hand grip body has a forward nose section in which is located a recess for a single blade having two sharpening edges. A retainer member attaches to the body and holds the blade in the recess. The retainer member and the cutting edges of the blade extend beyond the front end of the nose such that two sharpening slots are defined. The device is also provided with a hand guard.

7 Claims, 6 Drawing Figures

FIG. 2
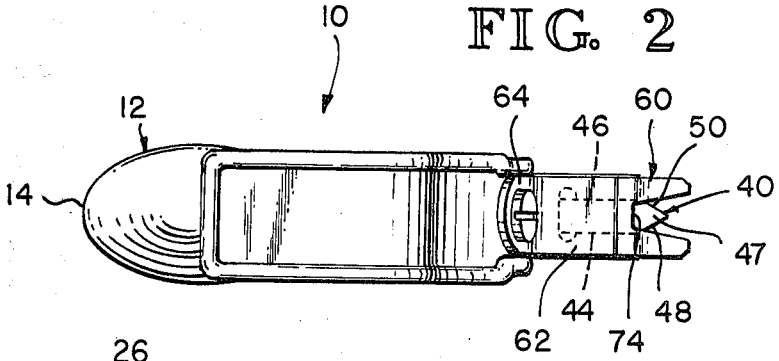
FIG. 3
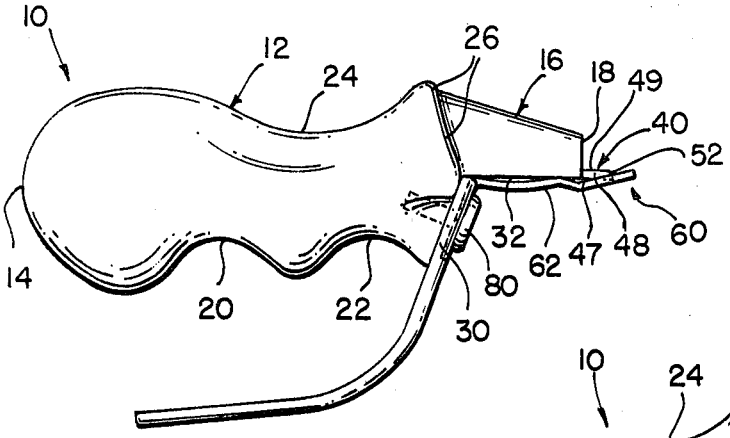
FIG. 1
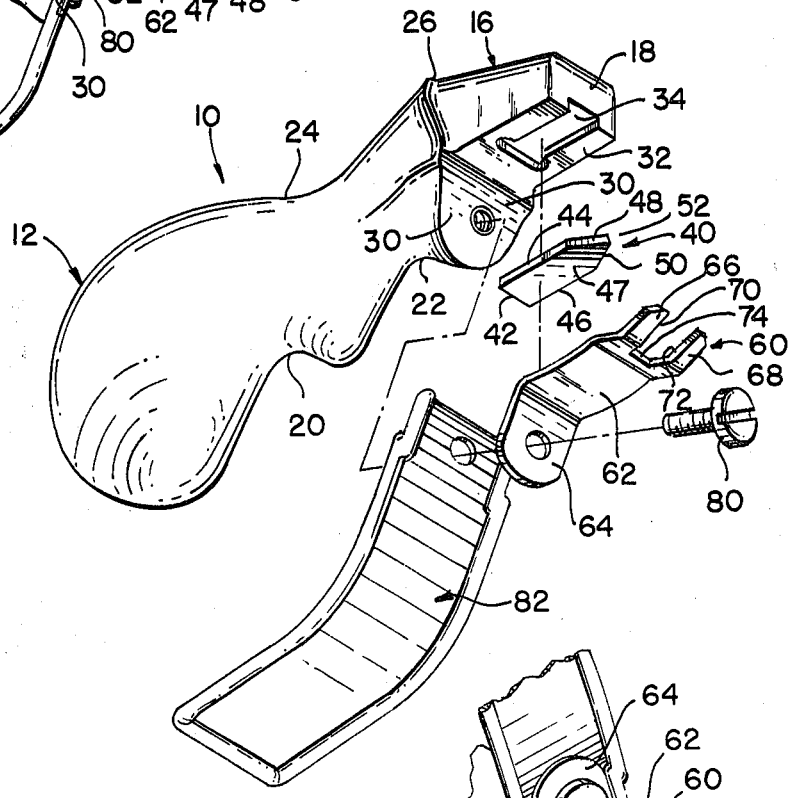
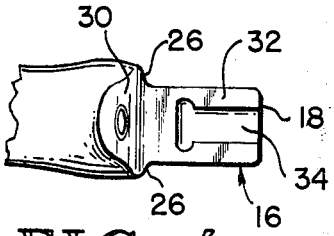
FIG. 4
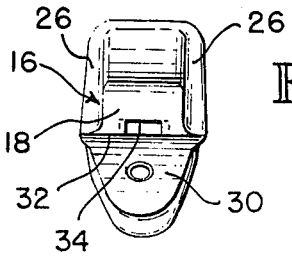
FIG. 5
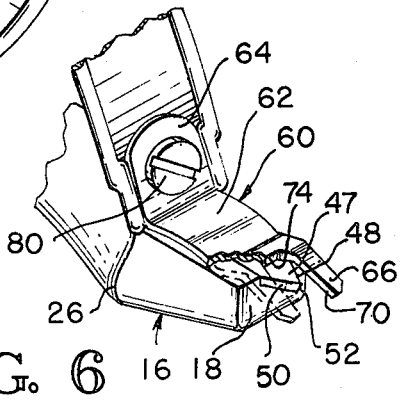
FIG. 6

SHARPENING DEVICE FOR SINGLE EDGE TYPE CUTTING BLADES

BACKGROUND OF THE INVENTION

The invention relates generally to the field of hand sharpening tools and more particularly to a hand held device for sharpening tools and instruments having single cutting edge type blades such as lawnmowers and the like.

As most people are aware, there are and have been a great variety of sharpening devices available for home, business, commercial and industrial uses, ranging from complicated and expensive grinders to simple home-type sharpeners. With sharpeners used for blades which have only one cutting edge, as for example lawnmowers, it is necessary to remove the blade from the mower so that it can be sharpened by the age old methods of grinder wheels or files. Thus, the sharpening chore is tedious and time-consuming. If in fact such sharpeners are not available, as for instance with scissors, then the owner must take them to a professional. What is true of lawnmowers and scissors is also true of tin snips, hedge trimmers, some sickles, blades for sawmill chippers, hand and electric grass trimmers. The feature which all of the above-identified tools have in common is that the cutting blades are sharpened on one side only. So far as applicant is aware, there is no tool on the market which is hand held and which can sharpen a blade such as for a lawnmower without removing the blade.

In any event, whether the device is hand held or whether it is bench mounted, they do become dull and must be periodically sharpened or they become useless.

The U.S. Patent to Heinmiller U.S. Pat. No. 3,149,506 is a sharpener for knives and tool bits and for deburring. The design of the patented device is such that it is intended for a different kind of operation and thus in principle and structure is significantly different.

SUMMARY OF THE INVENTION

Sharpening device for single cutting edge type blades which includes a hand grip section and which further includes a blade mounting nose on the forward end of the hand grip section. The blade mounting portion has a flat side with a recess for a single flat or planar blade member. The single blade member is generally rectangular except for the forward end thereof which has two cutting surfaces which converge to form a pointed end. The other three sides fit into the recess in the mounting nose with the double cutting edges or forward portion of the blade extending outwardly beyond the end of the nose. A blade retainer member is adapted to fit over the blade and hold it into place. A U-shaped cavity in the outer end of the retainer member has two spaced-apart tines which when the retainer member is in place define a guide edge for each of the two edges of the cutting blade.

Accordingly, it is among the features and advantages of this invention to provide a sharpening device which is adapted for hand use and which incorporates a single, replaceable blade means. The invention is inexpensive, simple in design but uniquely effective for sharpening tools such as lawnmowers, scissors, tin snips, hedge trimmers, sickles, blades for sawmill chippers, and hand and electrically operated grass trimmers and any other type of blade that is to be sharpened on one side only. The sharpening operation is accomplished quickly because blades do not have to be removed, as for instance from a lawnmower. The device can sharpen as it is moved from right to left or from left to right. The device is compact and eliminates tedious hand filing and bench grinding operations.

BRIEF DESCRIPTION OF THE DRAWINGS

FIG. 1 is an exploded view in perspective of the parts of the invention;

FIG. 2 is a bottom plan view of the assembled device;

FIG. 3 is a side elevation view of the assembled device showing additional details;

FIG. 4 is a partial bottom plan view of the nose portion showing the blade and retainer member removed;

FIG. 5 is a front end elevation of the device again without blade or retainer; and FIG. 6 is a partial perspective view showing additional details of the relationship between the blade, the nose and the retainer member.

DESCRIPTION OF PREFERRED EMBODIMENT

Referring now to the drawings, it will be seen that the invention, generally designated by the number 10, has a body which includes handle grip section 12, a rear end 14, a nose or blade mounting portion 16 and a front or nose end 18. The hand grip section 12 includes rounded finger depressions 20 and 22 together with a palm or hand grip back portion 24. It will be seen that the hand grip section 12 terminates at an offset edge portion 26, which angles slightly backwardly and an offset surface 30 which is generally planar and which as can be seen from the drawings, also angles slightly rearwardly from a generally converting point with edge 26.

The nose or blade mounting portion 16 extends out from the edges 26 to define a generally planar blade mounting surface 32. Note that blade mounting surface 32 of the nose extends generally straight forwardly from approximately the point where edge 26 and surface 30 meet. The blade mounting surface 32 extends forwardly on a plane roughly coincident with or parallel to the longitudinal axis of the handle grip portion 12.

Surface 32 is provided with a rectangular recess 34 centered on the surface and opening onto end 18. The rectangular recess 34 is approximately ½" long, slightly less than ¼" wide and formed to the depth of blade 40 to be described hereinafter.

Blade 40, preferably made of a tungsten carbide material, has a rear edge 42, side edges 44 and 46, and sharpening edges 48 and 50 which extend from the side edges to a point 52. The inclusive angle at which the sharpening edges converge is approximately 60°. It will be appreciated, reference being had to FIG. 3, which has been emphasized to illustrate a relief angle, that the sharpening edges 48 and 50 extend from the top surface 47 of the blade to the bottom surface 49 at a relief angle of approximately 5°, though this may vary if desired. When the blade 40 is in cavity 34, the sharpening edges 48 and 50 extend outwardly beyond the end surface 18 of nose 16.

The blade retainer 60 is a specially shaped piece having a center section 62 generally overlying the surface 32 and a mounting portion 64 which angles backwardly from section 62 to overlie offset surface 30. A forward portion of blade retainer 60 extends outwardly beyond the end surface 18 and includes a cutaway portion such that two spaced apart tines 66 and 68 are formed which thus define inside guide surfaces 70 and 72 and a bottom surface 74. Note that surface 74 is approximately coincident with end surface 18. Tines 66 and 68 are bent downwardly at a slight angle as best seen in FIGS. 1, 3 and 6 so that blade 40 is prevented from slipping forwardly out of its recess. The guide surfaces 70 and 72 on the inside of the spaced apart tines 66 and 68 provide guides for each of the cutting surfaces 48 and 50 of blade 40. Because of this unique combination of blade and retainer and the special configurations thereof the tool is able to sharpen a single edge cutting surface whether the user moves the sharpener from right to left or from left to right.

A hole is provided in offset surface 30 which in turn is provided with a metallic threaded insert to receive screw 80. A hand guard member generally designated by the number 82 is provided to protect the user's knuckles or fingers.

It will be seen that the tines 66 and 68 are shaped so that the inside guide edges 70 and 72 in combination with the angle at which the tines are disposed to section 62 overlap a small portion of the cutting edges closest to front end surface 18. In this manner, the blade is not only held securely into the cavity from above but also securely held from moving outwardly because of the overlying relationship of tines 66 and 68.

What is claimed is:

1. A sharpening device for tools and instruments having single cutting edge type blades such as lawnmowers and the like, comprising:

(a) a body having a front end and a rear end and including a hand grip section at said rear end over a substantial portion of said body, said body further including a blade mounting nose portion extending outwardly from said hand grip section and having an outer end which forms the front end of said body, (b) said blade mounting nose portion having a generally planar mounting surface extending from said outer end to said hand grip section such that a generally rearwardly angling offset surface is defined on said body, said mounting surface extending generally longitudinally forwardly from said offset surface;

(c) blade cavity means located in said mounting surface and being generally rectangularly shaped and extending from near said offset surface forwardly and opening on said front end for receiving sharpening blade means therein, (d) blade means detachably inserted in said cavity means, said blade means being of predetermined thickness and having a back end and sides configured to be received into said cavity means and having a sharpening end which extends forwardly and outwardly of said front end, said sharpening end being V-shaped to define two sharpening edges, and (e) blade guide and retainer means detachably secured to said offset surface and shaped to extend over substantially all of said blade mounting surface for holding said blade means securely in place, said blade guide and retainer means having a guide portion extending forwardly and outwardly of said front end and including a generally U-shaped opening such that a pair of spaced apart guide surfaces are formed so that the sharpening device may be used to sharpen the cutting edge of a tool blade which passes between a sharpening edge and one of said guide surfaces.

2. The sharpening device according to claim 1 and in which said blade cavity means has a depth equal to the thickness of said blade means.

3. The sharpening device according to claim 2, and in which said planar mounting surface on said nose portion extends outwardly generally from about the center of said body.

4. The sharpening device according to claim 3 and in which the sharpening edges of said blade means are formed so that the sharpening edges extend rearwardly at a predetermined relief angle from the top surface to the bottom surface.

5. The sharpening device according to claim 4 and wherein said predetermined relief angle is about 5°.

6. The sharpening device according to claim 5 and wherein said generally U-shaped opening of said blade guide and retainer means has an innermost surface which is generally coincident with said outer end of said nose portion.

7. The sharpening device according to claim 6 and in which said guide surfaces extend outwardly at a predetermined angle with respect to said sharpening edges so that two V-shaped sharpening cavities are formed.

* * * * *